US005299513A

United States Patent [19]

Kambara et al.

[11] Patent Number: 5,299,513

[45] Date of Patent: Apr. 5, 1994

[54] DRAWING DEVICE FOR TOWEL CLOTH

[75] Inventors: Tetsuo Kambara; Hideyuki Kobayashi, all of Utsunomiya, Japan

[73] Assignee: The Singer Company, NV, Caracus, Netherlands Antilles

[21] Appl. No.: 941,020

[22] Filed: Sep. 4, 1992

[30] Foreign Application Priority Data

Sep. 27, 1991 [JP] Japan ..... 3-274894

[51] Int. Cl.[5] ..... B26D 5/42

[52] U.S. Cl. ..... 112/121.26; 112/130; 83/175; 28/170; 28/160; 26/7

[58] Field of Search ..... 28/159, 160, 170; 26/7, 26/13, 2 R, 10.4, 10 R; 83/56, 61, 62, 63, 18, 949, 401, 436, 175, 18, 371, 36; 112/121.26, 130

[56] References Cited

U.S. PATENT DOCUMENTS

| | | | |
|---|---|---|---|
| 1,186,504 | 6/1916 | Wagner | 26/7 |
| 1,885,396 | 11/1932 | Wenzel | 26/7 |
| 4,034,634 | 7/1977 | Arbter | 83/175 |
| 4,375,175 | 3/1983 | Elsas et al. | 83/175 |
| 4,432,296 | 2/1984 | Grondin | 28/159 |
| 4,601,225 | 7/1986 | Starnes et al. | 83/175 |
| 4,609,182 | 9/1986 | Freerman | 83/175 |
| 4,915,042 | 4/1990 | Sotome et al. | 112/130 |
| 4,926,725 | 5/1990 | Helgesson | 83/175 |

*Primary Examiner*—Clifford D. Crowder
*Assistant Examiner*—Amy B. Vanatta

[57] ABSTRACT

A drawing device for towel cloth for successively drawing out and cutting off a towel material of long size as long as a sheet of towel from the rest of the towel material at the plain woven portion thereof, the towel material of long size having plain woven portions and pile fabric portions alternately and continuously arranged at predetermined intervals in the longitudinal direction thereof. The drawing device comprises a feed roller disposed perpendicular to the drawing direction of the towel cloth on the drawing side thereof relative to the cutting unit and capable of feeding back the cut end portion of the cut towel cloth on the drawing side to the side of the towel material relative to the cutting unit and a thickness detector disposed in the same way as the feed roller orthogonally to the drawing direction of the towel cloth having an aperture-adjustable slit for stopping the pile fabric portion of the fed back towel cloth thereby.

The length of the cut plain woven portion which is positioned adjacent to the cutting unit on the drawing side can be constant even if the dimensions of the plain woven portions of the towel material are varied. Moreover, it is simple in construction and can be manufactured with ease.

3 Claims, 6 Drawing Sheets

DRAWING DEVICE FOR TOWEL CLOTH

BACKGROUND OF THE INVENTION

1. Filed of the Invention

The present invention relates to a drawing device which is arranged so as to eliminate a variation in dimension of cut towel cloths which is liable to occur when the drawing device draws out and cuts off a towel material from the rest of the towel material at the plain woven portion thereof, the towel material having plain woven portions and pile fabric portions alternately and continuously arranged at predetermined intervals in the direction of elongation thereof.

2. The Prior Art

A conventional drawing device, which draws out and cuts off a towel material from the rest of the towel material at the plain woven: portion thereof, is provided with a thickness detector disposed in a line across the towel cloth perpendicular to the drawing (longitudinal) direction thereof for discriminating between the pile fabric portions and the plain woven portions thereof by the difference of thickness thereof etc., so as to locate the borders between the two portions whereby the towel cloth can be cut as close as possible at the centres of the plain woven portions.

For example, a conventional towel cloth drawing device is disclosed in Japanese Utility Model Laid-Open Publication No.2-392. The towel cloth drawing device comprises a thickness detector for discriminating between pile fabric portions and plain woven portions of a towel cloth. The device includes a cutting unit arranged at the outer side of a first working table and a fixed metal plate and a clamping unit arranged on a second working table. Both tables are disposed oppositely while defining a space therebetween. The fixed metal plate projects from the inner end portion of a base plate movable toward the first working table. The clamping unit is equipped with a movable plate swingably pivotally supported thereby above the fixed metal plate. The device utilizes a towel cloth drawing unit which is vertically movable and extends across and above the cloth and over the space between the first and second working tables.

However, in this known towel cloth drawing device, the length of a plain woven portion of a cut towel cloth adjacent to the cutting unit on the drawn out side can vary, which can result in uneven rolled hems when rolled hemming is performed to the plain woven portion by an automatic towel sewing machine.

More particularly, when a towel cloth A is cut off from the towel material as illustrated in FIGS. 13 and 14, the length FL' of the cut plain woven portion A2 which is positioned adjacent to the cutting unit on the side of the towel material is equal to the space between the position of the thickness detector (X—X line) for discriminating between the pile fabric portion A1 and the plain woven portion A2 and the position of the cutter of the cutting unit (Y—Y line). The length CL', which is the length of the plain woven portion A2 positioned adjacent to the cutting unit on the drawing side of the towel cloth, is obtained by subtracting the length FL' from the entire length HL of the plain woven portion A2 thereof.

Consequently, the length CL' of the cut plain woven portion A2 on the drawn out side of the towel cloth is variable due to the inevitable variation of the entire lengths HL of the plain woven portions A2 of the towel material. As a result, hemming portions formed with the plain woven portions A2 can include the pile fabric portion A1 or the plain woven portions A2 can appear outside the rolled hemming portions (when the hemming is performed by an automatic towel sewing machine), which causes the quality of the sewn towel products to deteriorate. Consequently in order to produce comparatively high quality towel products wherein the pile fabric portion is close to the rolled hemming portion, the rolled hemming portion has to be manually sewn to maintain the quality of the products.

SUMMARY OF THE INVENTION

The present invention is directed toward a new and improved towel cloth drawing device which produces comparatively high quality towel products which can be hemmed properly by machine with out requiring manually sewn hemming.

A towel cloth drawing device in accordance with the invention utilizes a feed roller which extends across the towel cloth in the direction perpendicular to the drawing direction on the drawing side relative to the cutting unit and is capable of feeding back the cut end portion of the towel cloth positioned adjacent to the cutting unit on the drawing side after the same is cut at the plain woven portion thereof. The device also utilizes a thickness detector which is also disposed perpendicular to the drawing direction and has a slit the depth of which is adjustable in order to determine whether or not to feed back a portion of the pile fabric of the towel cloth to the side of the towel material.

At first, a towel material is drawn out and cut off as long as a sheet of towel from the rest of the towel material at the plain woven portion thereof. This towel material has plain woven portions and pile fabric portions alternately and continuously arranged at predetermined intervals in the drawing (longitudinal) direction thereof. The lengths of the plain woven portions of the drawn out and cut towel cloths are variable. The feed roller is brought into contact with the sheet of towel cloth which has been cut off at the plain woven portion by a cutting unit at the position adjacent to the cut edge. The roller is rotated to feed back the cut end portion of the drawn out and cut end side of the towel cloth. The depth of the slit of the thickness detector is adjusted so as to prevent the pile fabric portion of the towel cloth from passing therethrough to the side of the towel material of long size. Consequently the towel cloth can be cut at a constant distance from the thickness detector, resulting in a constant length of the plain woven portion of the drawn out towel cloth.

Since the length of the cut plain woven portion which is positioned adjacent to the cutting device on the drawing side can be held constant even if the dimensions of the plain woven portions of the towel material vary, the length of the cut plain woven portion positioned on the drawing side of the towel material of long size. As a result, towels of high quality can be sewn wherein plain woven portions do not appear irregularly at the borders between rolled hem portions and pile fabric portions. Moreover, the device is simple in construction and can be manufactured with ease.

PREFERRED EMBODIMENT OF THE PRESENT INVENTION

A preferred embodiment of the present invention will be described with reference to drawings hereinafter.

Figure 13:
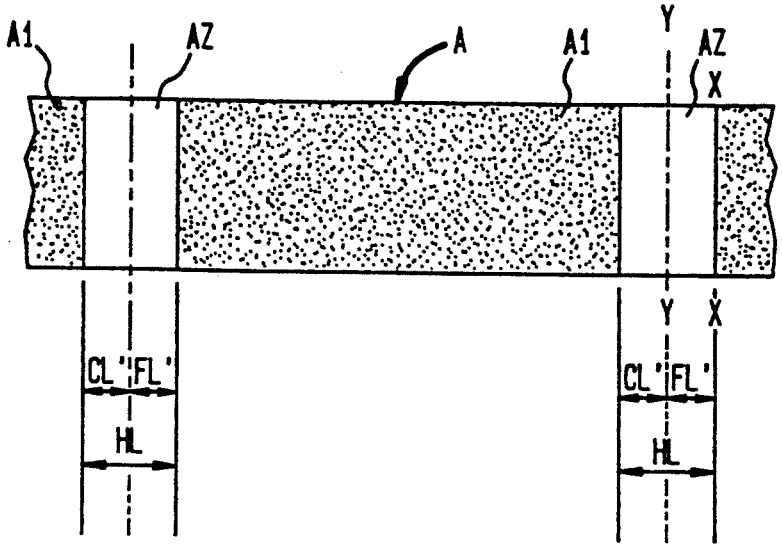
FIG. 13 is a plan view showing a towel material of long size.
Figure 14:
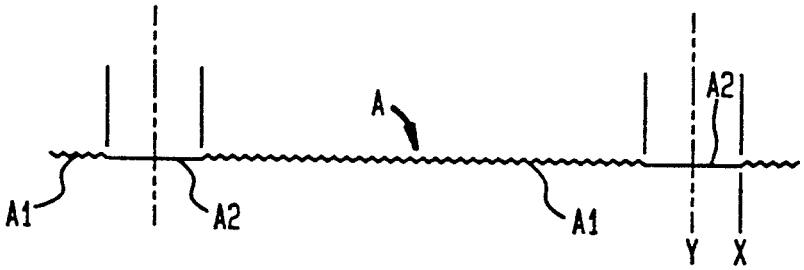
FIG. 14 is a front view showing the towel material of long size.

FIGS. 1 to 11 are views showing the embodiment. FIGS. 12 to 14 are views showing in detail a towel material composed of a series of towel cloths A, having pile fabric portions A1 and plain woven portions A2 alternately and continuously arranged at predetermined intervals in the longitudinal direction thereof.

Figure 1:
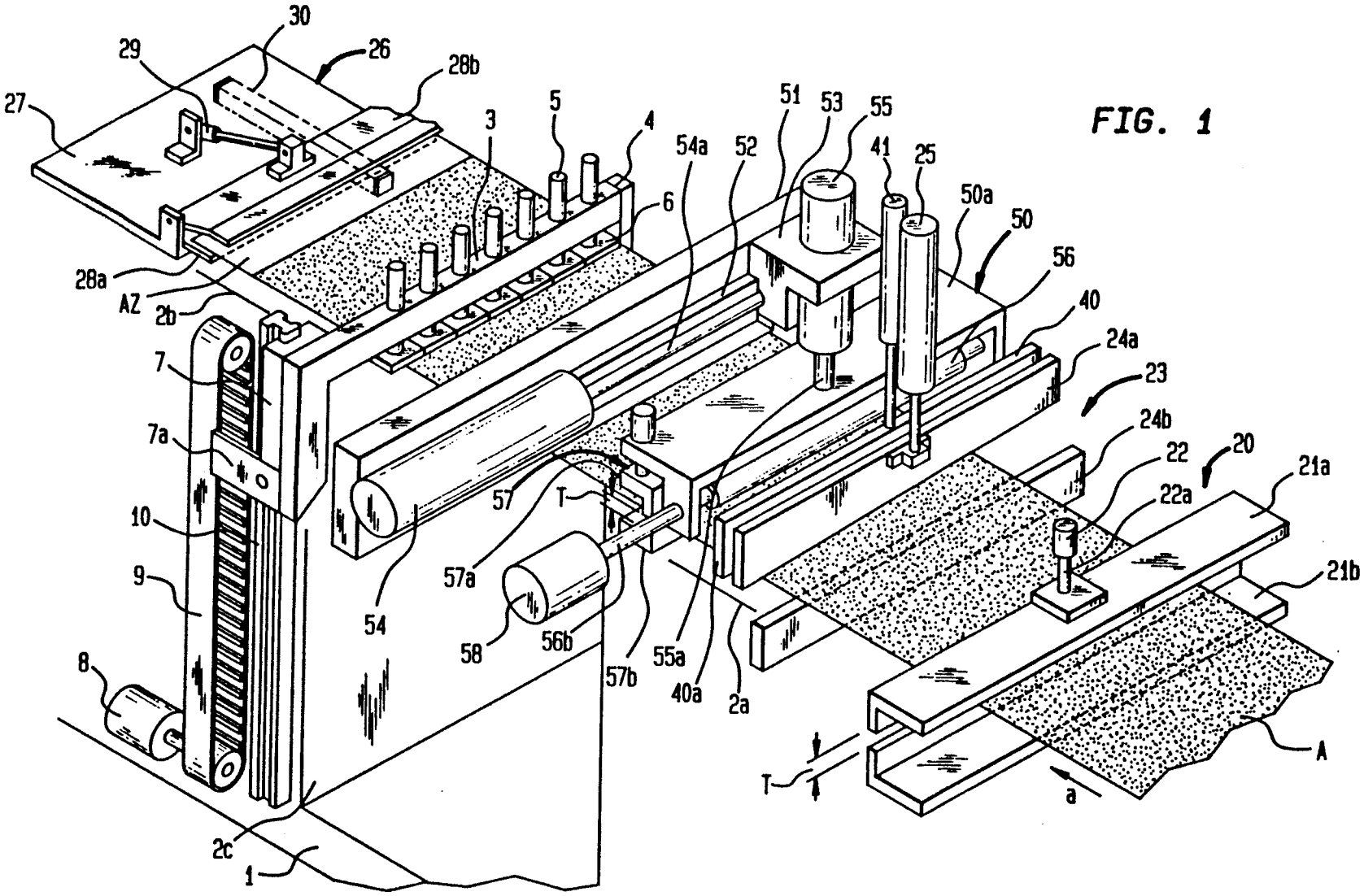
FIG. 1 is a perspective view of a drawing device for towel cloth according to a preferred embodiment of the present invention.

In FIG. 1, denoted at 1 is an automatic towel sewing machine body. A first working table 2*a* and a second working table 2*b* are integrally provided with the automatic towel sewing machine 1, confronting with each other and having a space 2*c* therebetween. A first thickness detector 20 for discriminating between the pile fabric portion A1 and the plain woven portion A2 of towel cloth A is provided on the first working table 2*a* at the side of the towel material thereof.

The first thickness detector 20 comprises an upper block 21*a* and a lower block 21*b* disposed in a line across the towel cloth A perpendicular to the drawing direction thereof as illustrated by an arrow a. A pneumatic actuator 22 positions the upper block 21*a*. The upper block 21*a* is fixed to the tip end of the piston rod 22*a* of the positioning pneumatic actuator 22. Actuator 22 fixedly mounted on the automatic towel sewing machine body 1 by way of a supporting body (not shown) The lower block 21*b* is fixedly mounted on the automatic towel sewing machine 1 by way of a supporting member (not shown), so as to form an aperture-adjustable slit T with the upper and lower blocks 21*a* and 21*b*.

Figure 2:
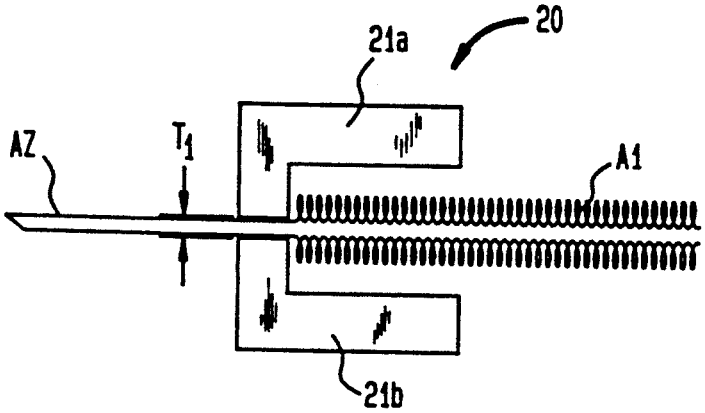
FIG. 2 is a view showing a first thickness detector in FIG. 1.

When the pneumatic actuator 22 is operated forward to lower the upper block 21*a* so as to form a small stop aperture T1 with the lower block 21*b*, the depth of T1 is set so that the plain woven portion A2 can pass through the aperture T1 but the pile fabric portion A1 is stopped thereby as illustrated in FIG. 2.

A cutting unit 23 is disposed on the drawing side at a given distance from the first thickness detector 20. That is, the cutting unit 23 is provided on a position (Y—Y line) one half of the minimum entire length HL (min) apart form the first thickness detector 20. The minimum entire length H1 (min) is calculated by subtracting a specified deviation quantity (G) from the maximum length HL (max) of the plain woven portion A2 as illustrated in FIG. 12. A cutting unit 23 is disposed across the towel cloth A at right angles to the drawing direction thereof, and includes a movable cutter 24*a*, a fixed cutter 24*b* fixedly mounted on the first working table 2*a* and a pneumatic actuator 25 which is fixed to the automatic towel sewing machine 1 by way of a supporting member (not shown) and a piston rod of which is fixed to the movable cutter 24*a*.

When the pneumatic actuator 25 is operated forward, the movable cutter 24*a* is moved toward the fixed cutter 24*b* to cut the towel cloth A between the cutters 24*a* and 24*b*.

A bar-shaped pressing device 40 is provided across the towel cloth A perpendicular to the drawing direction thereof. The pressing device 40 fixedly presses the towel cloth A on the first working table 2*a* with the pressing member 40*a* fixed to the piston rod of the pneumatic actuator 41 by operating the same forward when the towel cloth A is cut.

A towel cloth feed back unit 50 is mounted on a bracket 53 guided by a guide rail 52 extended orthogonally to the drawing direction of the towel cloth A by way of a supporting member 51 fixed to the automatic towel sewing machine body 1.

Since the bracket 53 is fixed to the tip end of the piston rod 54*a* of the pneumatic actuator 54 fixedly mounted on the automatic towel sewing machine body 1, it is moved to the position over the towel cloth A by operating the pneumatic actuator 54 forward.

A pneumatic actuator 55 is fixedly mounted on the bracket 53, and a frame body 50*a* is fixed to the tip end of the piston rod 55*a* of the pneumatic actuator 55. The frame body 50*a* rotatably supports a feed roller 56 disposed orthogonally to the drawing direction of the towel cloth A, the feed roller 56 being driven by a DC motor 58 which is driven by a control circuit (not shown) by way of a fed roller shaft 56*b*. The motor 58 is fixedly mounted on the frame body 50*a* by a supporting member, not shown.

The towel cloth feedback unit 50 can feed back the towel cloth A toward the side of the towel material of long size by driving the motor 58 (since the tip portion of the piston rod 55*a* of the pneumatic actuator 55 fixed to the supporting member 51 is connected to the bracket 53) so that the towel cloth feedback unit 50 is lowered to the towel cloth A and the feed roller 56 is brought into contact with the towel cloth A when the pneumatic actuator 55 is operated forward.

Figure 3:
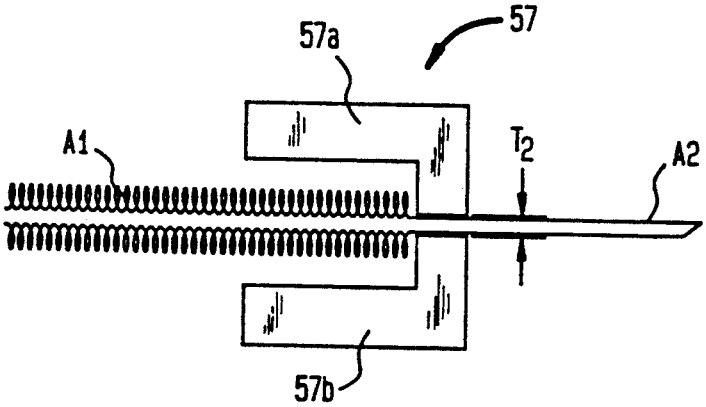
FIG. 3 is a view showing a second thickness detector in FIG. 1.

The towel feedback unit 50 is also provided with a second thickness detector 57 having construction similar to that of the first thickness detector 20 as illustrated in FIG. 3. A lower block 57*b* fixedly mounted on the first working table 2*a* and an upper block 57*a* fixedly mounted on the frame body 50*a* forms a slit for discriminating the difference in thickness between the pile fabric portion A1 and the plain woven portion A2.

When the pneumatic actuator 55 is operated forward to lower the upper block 57*a* together with feed roller 56 so as to form a small stopping aperture T2 cooperating with the lower block 57*b* at the slit as illustrated in FIG. 3, the plain woven portion A2 passes through the aperture T2 but the pile fabric portion A1 is stopped thereby. The installation height of the upper block 57*a* on the frame body 50a is set so as to form the stopping aperture T2 when the feed roller 56 is in contact with the towel cloth A. The lower block 57b can be also formed by processing the first working table 2a itself.

The second thickness detector 57 and the first thickness detector 20 are disposed symmetrically on both sides of the cutting unit 23. The distance between the pile fabric portion A1 retained at the slit T of the second thickness detector 57 and the cutting unit 23 and the distance between the pile fabric portion A1 retained at the slit T of the first thickness detector 20 an the cutting unit 23 are adjusted to be equal.

A towel cloth drawing means 3 is disposed at the central portion of the space 2c between the two working tables 2a and 2b, and a towel cloth drawing means body 4 composed of a vertically movable L-shaped bar member is disposed across the towel cloth A perpendicular to the drawing direction thereof.

The towel cloth drawing means body 4 comprises a plurality of correction pneumatic actuators 5 equally spaced from each other, the towel cloth drawing means body 4 being pierced by each piston rod of the pneumatic actuators. A presser piece 6 is fixed to the tip end of each piston rod to be brought into contact with and press down the surface of the towel cloth A in such a way as to avoid a mutual interference. A bracket 7 is fixedly mounted on an end portion of the towel cloth drawing means unit body 4, and a timing belt 9 which is vertically driven by a drive-motor 8 and a guide rail 10 vertically disposed along the belt 9 are provided on a side surface of the automatic towel sewing machine body 1. The bracket 7 engages the guide rail 10 to be guided thereby, and a belt clip 7a fixed to the bracket 7 engages the timing belt 9.

When the drive motor 8 is rotated normally or reversely, the towel cloth drawing means body 4 is moved upward or downward. When air is supplied to each correction pneumatic actuator 5 to thereby operate its piston rod forward, each presser piece 6 presses down the upper surface of the towel cloth A so that the portions of the towel cloth A on which each presser piece 6 applies force can be drawn near respectively.

A clamping unit 26 is provided on the second working table 2b for clamping the plain woven portion A2, which serves as an end portion for drawing out the towel cloth A. The clamping unit 26 comprises a base plate 27 movable on the second working table 2b, a nipper having a plate 28a fixedly mounted on the base plate 27, and a movable plate 28b swingably pivotally supported by the base plate 27, and a pneumatic actuator 29 provided between the movable plate 28b and the base plate 27, and a moving device 30 comprising a movable portion fixed to the lower surface of the base plate 27 and a fixed portion fixed to the automatic sewing machine body 1 is attached thereto.

With such arrangement set forth above, the pneumatic actuator 29 is operated forward to press the movable plate 28b against the fixed plate 28a so as to clamp the towel cloth A, or the pneumatic actuator 29 is operated backward to separate the movable plate 28b from the fixed plate 28a so as to release the towel cloth A. The base plate 27 can be reciprocated along the drawing direction a of the towel cloth A by driving the moving device 30.

The first thickness detector 20, the cutting unit 23, the pressing device 40, the towel cloth pushing back unit 50, the towel cloth drawing means 3 and the clamping unit 26 are arranged in turn from the first working table 2a to the second working table 2b thereon.

An operation of the embodiment set forth above will be described hereinafter with reference to FIGS. 4 to 11.

Figure 4:
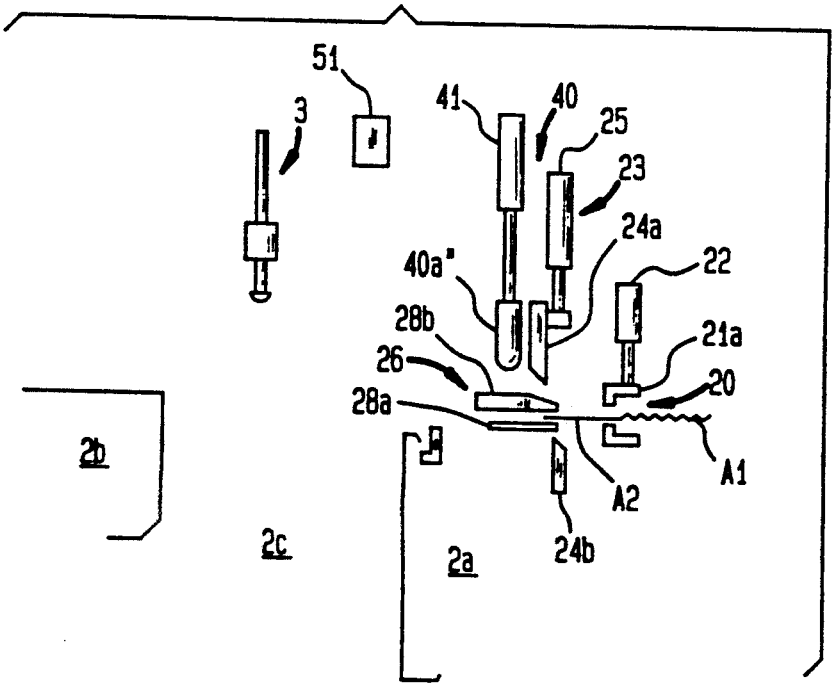
FIG. 4 is a view for explaining the operation of the drawing device in FIG. 1.

As illustrated in FIG. 4, before the operation of drawing out the towel cloth A:

(a) the towel cloth drawing means 3 is at its upper position as the result of the normal rotation of the drive motor 8, (b) the movable cutter 24a is at its upper position as the result of the backward operation of the pneumatic actuator 25 in the cutting unit 23, (c) the upper block 21a is at its upper position so that the slit T can pass the thick pile fabric portion A1 of the towel cloth A therethrough as the result of the backward operation of the pneumatic actuator 22 in the first thickness detector 20, (d) the pressing member 40a is at its upper position as the result of the backward operation of the pneumatic actuator 41 in the pressing device 40, and (e) the towel cloth feedback unit 50 is not positioned above the towel cloth A as the result of the backward operation of the pneumatic actuator 54.

Starting from the state set forth above, the moving device 30 is operated forward so as to move the clamping unit 26 to the opening portion of the cutting unit 23 and clamp the towel cloth A at the plain woven portion A2 thereof with the movable plate 28b and the fixed plate 28a.

Figure 5:
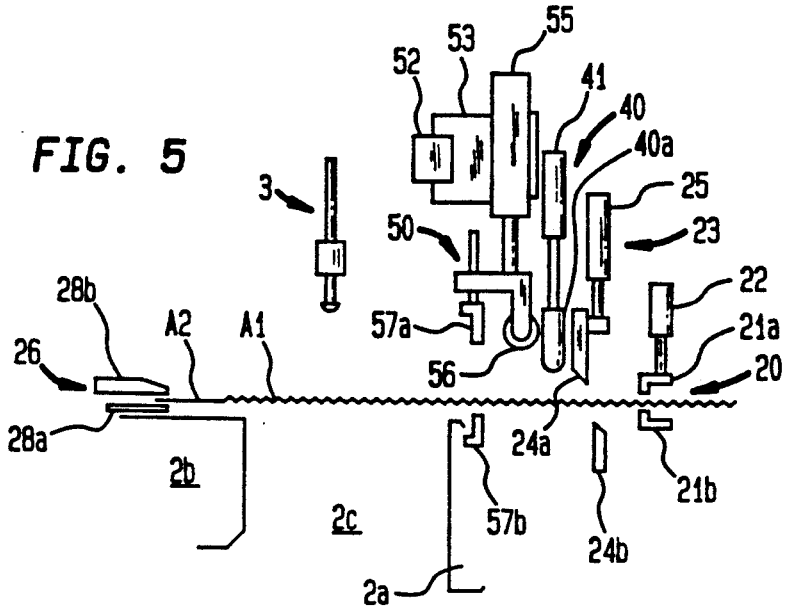
FIG. 5 is a view for explaining the operation of the drawing device in FIG. 1.

FIG. 5 shows a state where:

(a) the moving device is operated backward so that the clamping unit 26 is retracted so as to draw out the towel cloth A substantially as long as a sheet of towel, and (b) the pneumatic actuator 54 is operated forward so that the towel cloth feedback unit 50 is disposed above the upper portion of the towel cloth A.

Figure 6:
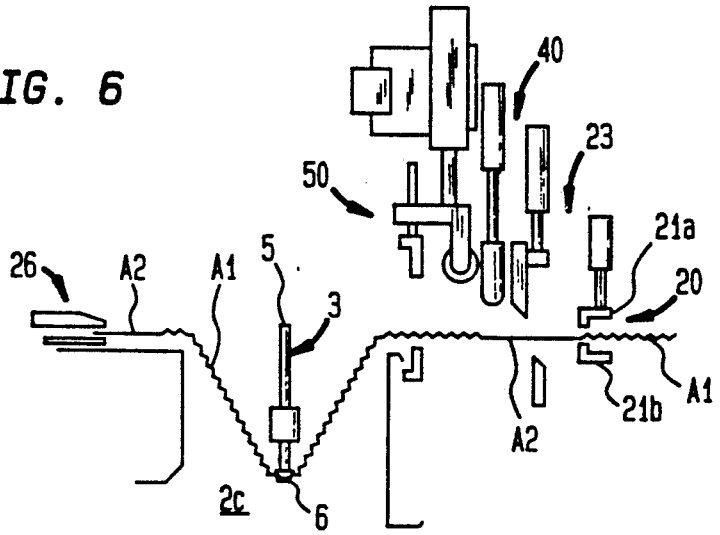
FIG. 6 is a view for explaining the operation of the drawing device in FIG. 1.

FIG. 6 shows a state where:

(a) the drive motor 8 is reversely driven to lower the towel cloth drawing means 3 and the towel cloth A is pressed down all over toward the space 2c so that the portion adjacent to the end portion of next plain woven portion A2 on the side of the towel material of long size reaches the slit T formed between the upper and lower blocks 21a and 21b of the first thickness detector 20.

Figure 7:
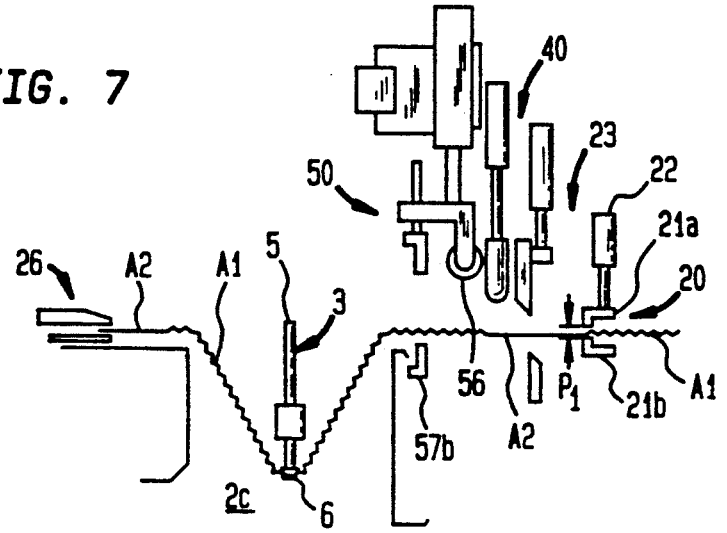
FIG. 7 is a view for explaining the operation of the drawing device in FIG. 1.

FIG. 7 shows a state where:

(a) the pneumatic actuator 22 is operated forward to lower the upper block 21a so as to form a stop aperture T1, which passes a thin plain woven portion A2 but does not pass a thick pile fabric portion A1 therethrough, at the slit formed between the upper and lower blocks 21a and 21b as illustrated in FIG. 2, and (b) each correction pneumatic actuator 5 is operated forward so as to press down the pile fabric portion A1 with each presser piece 6 so that the portion of the towel cloth A to which each presser piece 6 applies force is respectively drawn near, and the portion adjacent to the end portion of next pile fabric portion A1 on the drawing side thereof is aligned in the slit formed between the upper and lower blocks 21a and 21b of the first thickness detector 20.

Figure 8:
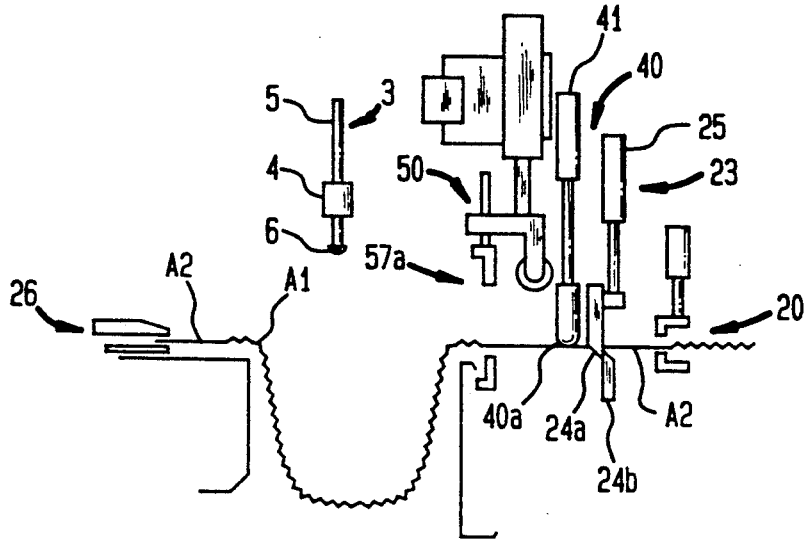
FIG. 8 is a view for explaining the operation of the drawing device in FIG. 1.

FIG. 8 shows a state where:

(a) the drive motor is normally driven to raise the towel cloth drawing means 3 to its home position, (b) the pneumatic actuator 41 is operated forward so that the pressing member 40a lowers to the surface of the towel cloth A and press the same on the first working table 2*a* to fixedly hold next plain woven portion A2, and (c) the pneumatic actuator 25 of the cutting unit 23 is operated forward to thereby cut the towel cloth A at the plain woven portion A2 thereof with the cutters 24*a* and 24*b*. The cutting position is represented by a Y—Y line which is one half of the minimum entire length HL (min) apart from the end portion of the pile fabric portion A1 retained by the first thickness detector 20 on the drawing side thereof as illustrated in FIG. 12, the minimum entire length HL (min) being given by subtracting the specified deviation quantity (G) from the maximum length HL (max) of the plain woven portion A2. As a result, a constant length FL of the plain woven portion A2 positioned adjacent to the cutters 24*a* and 24*b* on the side of the towel material of long size can be obtained.

Figure 9:
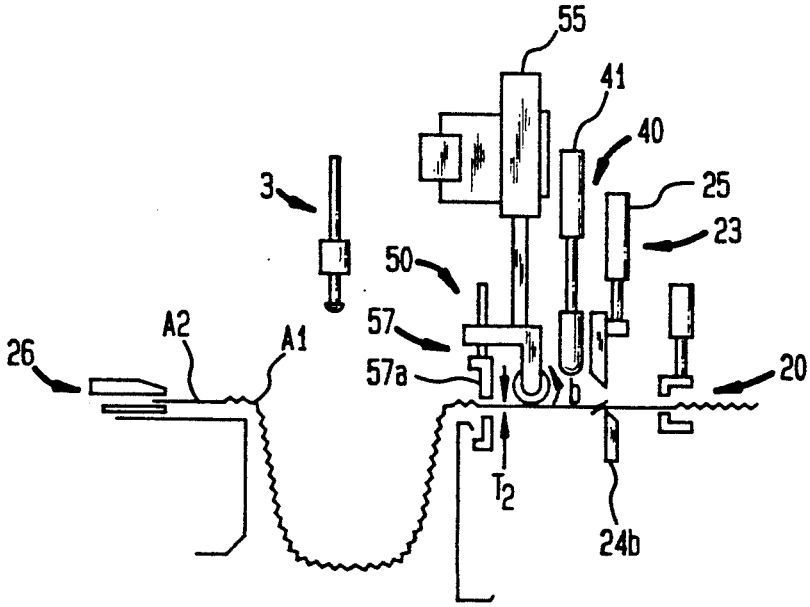
FIG. 9 is a view for explaining the operation of the drawing device in FIG. 1.

FIG. 9 shows a state where:

(a) the pneumatic actuator 55 is operated forward so that the feed roller 56 of the towel cloth feedback unit 50 is lowered and is brought into contact with the surface of the towel cloth A and a stop aperture T2 is formed at the slit formed between the upper and lower blocks 57*a* and 57*b*, (b) the pneumatic actuator 41 is operated rearward so as to temporarily, release the pressure which has been applied to the surface of the towel cloth A by the pressing member 40*a*, and (c) the motor 58 causes the feed roller 56 to rotate in the direction of the arrow b so as to feed back the cut portion of the cut towel cloth A toward the towel material of long size until the pile fabric portion A1 which is positioned adjacent to the cutters 24*a* and 24*b* on the drawing side is retained by the stop aperture T2.

Figure 10:
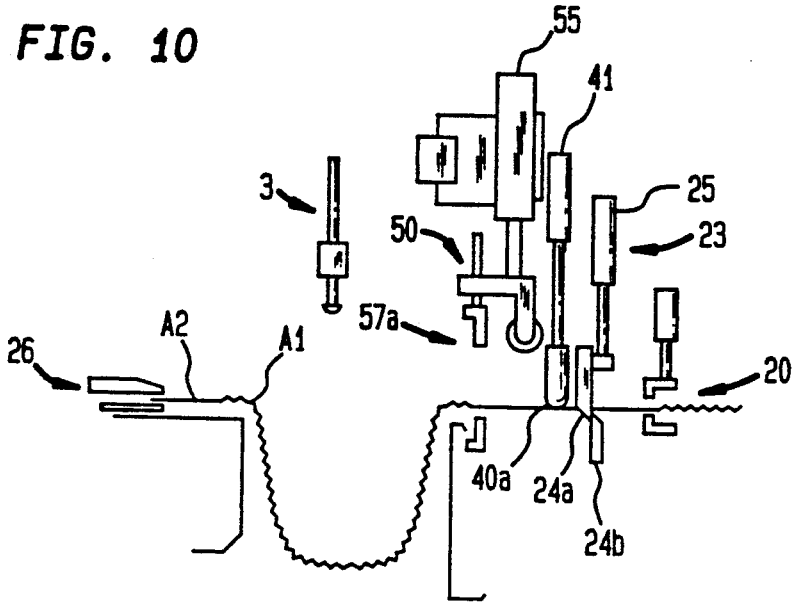
FIG. 10 is a view for explaining the operation of the drawing device in FIG. 1.

FIG. 10 shows a state where:

(a) the pneumatic actuator 41 is operated forward so that the pressing member 40*a* lowers to the surface of the towel cloth A and presses the same on the first working table 2*a*, (b) the pneumatic actuator 55 is operated backward so that the upper block 57*a* of the second thickness detector 57 and the feed roller 56 of the towel cloth feedback unit 50 are raised together to be separated from the surface of the towel cloth A, (c) the pneumatic actuator 25 of the cutting unit 23 is operated forward so as to operate cutters 24*a* and 24*b* and cut off the excessive length of cloth which generates from the specified duration amount (G) of the plain woven portion A2 and is fed back toward the side of the towel material. The cutting position is represented by a Y—Y line which is one half of the minimum entire length HL (min) apart from the end portion of the pile fabric portion A1 retained by the second thickness detector 57. As explained above minimum entire length HL (min) is calculated by subtracting the amount (G) from the maximum length HL (max) of the plain woven portion A2. As a result, a constant length CL of the plain woven portion A2 positioned adjacent to the cutters 24*a* and 24*b* on the drawing side thereof can be obtained in the same way as the constant length FL on the opposite side thereof.

Figure 11:
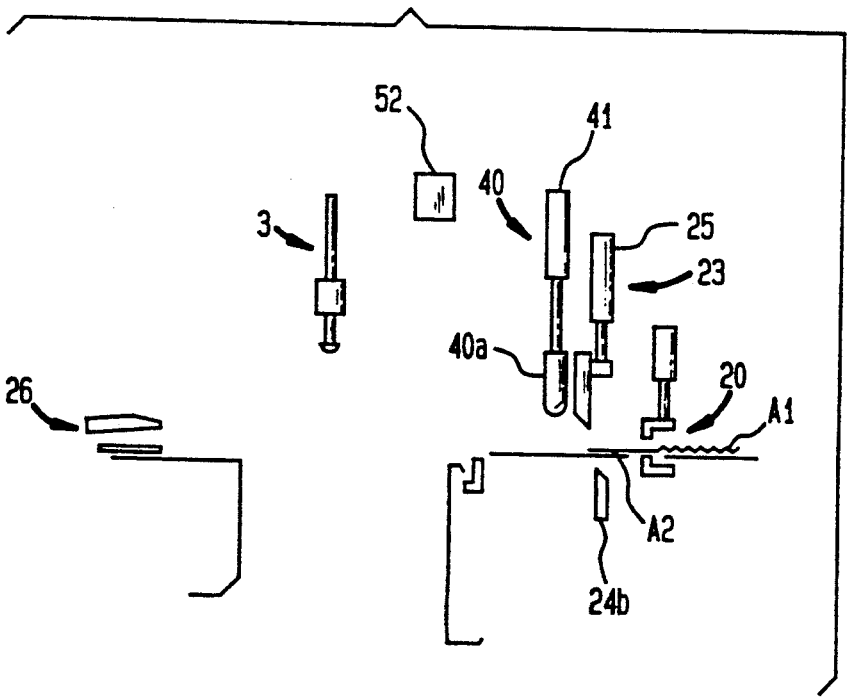
FIG. 11 is a view for explaining the operation of the drawing device in FIG. 1.
Figure 12:
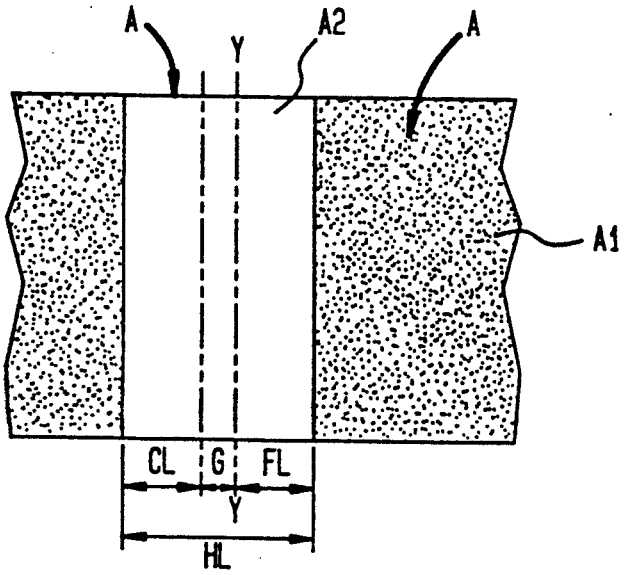
FIG. 12 is a plan view showing a plain woven portion of the towel cloth.

FIG. 11 is a state where:

(a) the pneumatic actuator 41 is operated backward so that the pressure which has been applied on the towel cloth A by the pressing member 40*a* is released, (b) the pneumatic actuator 54 is operated backward so that the frame body 50*a* of the towel cloth feedback unit 50 is separated from the portion above the towel cloth A, (when the upper block 57*a* and the towel cloth feedback unit 50 are sufficiently raised to their home positions by the pneumatic actuator 55, the pneumatic actuator 54 can be omitted) and (c) the clamping unit 26 stops to clamp the plain woven portion A2 of the towel cloth A and a sheet of cut towel cloth A is transported from the space 2*c* to next process.

A series of such processes as described above are successively repeated so that a plurality of towel cloths A are cut off from the towel material.

Although the second thickness detector 57 is disposed on the drawing side relative to the feed roller 56 of the towel cloth feedback unit 50 according to the embodiment set forth above, it is also possible to feed the plain woven portion A2 of the cut towel cloth A to the second thickness detector 57 disposed on the side of the towel material by disposing the feed roller 56 on the drawing side.

What is claimed is:

1. A device wherein cloth is drawn and cut from towel material having longitudinally extending lengths of pile fabric, each pair of adjacent lengths of pile fabric being separated by an intervening length of plain fabric, the lengths of the plain fabric being variable, the cloth being cut transversely across each intervening length, the device being adapted to eliminate variations in length of the cut cloth which would otherwise occur, said device comprising:

first and second work tables integral with an automatic sewing machine body, the tables being disposed opposite and spaced apart from each other;

first and second thickness detectors spaced apart and located adjacent the middle and an end of the first table respectively, each detector passing plain fabric lengths therethrough and blocking passage therethrough of the lengths of pile fabric;

a cloth drawing unit disposed over the space between the tables and extending across a width of the cloth for drawing cloth from the material;

a clamping unit mounted on the second table for clamping the plain fabric lengths and for drawing the towel cloth;

a cutting unit disposed across the first table and spaced from the first detector, the cutting unit including a mechanism for cutting each length of fabric cloth, the clot cutting unit being disposed equidistantly between the first and second detectors; and means secured to the one of the first and second detectors and disposed therebetween, said means including a feed roller which engages each length of fabric cloth and rolls it to a position at which the cutting unit cuts each length along a longitudinal center line thereof.

2. The device of claim 1 wherein said means positions the roller in a first raised position after a length of fabric cloth has been cut and positions the roller in a second lowered position for engaging the next adjacent length of fabric cloth prior to cutting.

3. The device of claim 2 wherein said means causes the roller to rotate when in the second position and stops the roller from rotating when in the first position.

* * * * *